US007771178B2

(12) United States Patent
Perevozchikov et al.

(10) Patent No.: US 7,771,178 B2
(45) Date of Patent: Aug. 10, 2010

(54) VAPOR INJECTION SYSTEM FOR A SCROLL COMPRESSOR

(75) Inventors: Michael Perevozchikov, Tipp City, OH (US); Roy J Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 878 days.

(21) Appl. No.: 11/645,288

(22) Filed: Dec. 22, 2006

(65) Prior Publication Data

US 2008/0152526 A1 Jun. 26, 2008

(51) Int. Cl.
*F04B 23/00* (2006.01)
*F04B 41/00* (2006.01)

(52) U.S. Cl. ..... 417/440; 418/55.6; 418/87; 418/99; 418/270

(58) Field of Classification Search ..... 418/15, 418/55.1–55.6, 57, 270, 84, 87, 99; 417/310, 417/440, 299
See application file for complete search history.

(56) References Cited

U.S. PATENT DOCUMENTS

| | | | | |
|---|---|---|---|---|
| 4,058,988 | A | 11/1977 | Shaw | |
| 4,216,661 | A | 8/1980 | Tojo et al. | |
| 4,475,360 | A | 10/1984 | Suefuji et al. | |
| 4,545,742 | A | 10/1985 | Schaefer | |
| 4,609,329 | A | 9/1986 | Pillis et al. | |
| 4,727,725 | A | 3/1988 | Nagata et al. | |
| 4,877,382 | A * | 10/1989 | Caillat et al. | 418/55.5 |
| 5,055,010 | A * | 10/1991 | Logan | 418/55.6 |
| RE34,148 | E | 12/1992 | Terauchi et al. | |
| 5,253,489 | A | 10/1993 | Yoshii | |
| 5,640,854 | A * | 6/1997 | Fogt et al. | 418/55.6 |
| 5,674,058 | A | 10/1997 | Matsuda et al. | |
| 5,722,257 | A | 3/1998 | Ishii et al. | |
| 6,095,765 | A | 8/2000 | Khalifa | |
| 6,139,287 | A | 10/2000 | Kuroiwa et al. | |
| 6,202,438 | B1 | 3/2001 | Barito | |

(Continued)

FOREIGN PATENT DOCUMENTS

JP 60259794 A * 12/1985

(Continued)

OTHER PUBLICATIONS

Extended European Search Report regarding Application No. EP07254962 dated Mar. 12, 2008.

*Primary Examiner*—Theresa Trieu
(74) *Attorney, Agent, or Firm*—Harness, Dickey & Pierce, P.L.C.

(57) ABSTRACT

A compressor may include a shell, a compression mechanism, a motor, and a vapor injection system. The compression mechanism may be contained within in the shell and include a non-orbiting scroll axially displaceably mounted to the shell. The non-orbiting scroll may have an exterior portion, an interior portion, and a vapor injection passage extending therethrough from the exterior portion to the interior portion. The motor may be contained within the shell and may be drivingly coupled to the compression mechanism. The vapor injection system may include a vapor injection device, a vapor injection fitting, and a vapor injection valve. The vapor injection fitting may be in communication with the vapor injection device and the vapor injection passage. The vapor injection valve may be disposed between the shell and the interior of the non-orbiting scroll.

28 Claims, 5 Drawing Sheets

U.S. PATENT DOCUMENTS 6,293,776 B1 * 9/2001 Hahn et al. ..... 418/55.5
6,350,111 B1 * 2/2002 Perevozchikov et al. .... 417/440
6,679,683 B2 * 1/2004 Seibel et al. ..... 418/57
6,773,242 B1 * 8/2004 Perevozchikov ..... 418/55.2
6,863,510 B2 3/2005 Cho
6,893,229 B2 5/2005 Choi et al.
2004/0126259 A1 7/2004 Choi et al.
2005/0214148 A1 9/2005 Ogawa et al.

FOREIGN PATENT DOCUMENTS

JP 11107950 A * 4/1999
JP 2003074482 A * 3/2003

* cited by examiner

VAPOR INJECTION SYSTEM FOR A SCROLL COMPRESSOR

FIELD

The present disclosure relates to scroll compressors and more specifically to vapor injection systems for scroll compressors.

BACKGROUND AND SUMMARY

Refrigerant compressors for cooling systems such as air conditioning, refrigeration or chiller systems, may include a vapor injection system to increase operating efficiency and capacity. During operation, passages between the vapor injection system and the compression mechanism may create dead volume that is compressed, consuming energy unnecessarily.

A compressor may include a shell, a compression mechanism, a motor, and a vapor injection system. The compression mechanism may be contained within the shell and include a non-orbiting scroll axially displaceably mounted to the shell. The non-orbiting scroll may have an exterior portion, an interior portion, and a vapor injection passage extending therethrough from the exterior portion to the interior portion. The motor may be contained within the shell and may be drivingly coupled to the compression mechanism. The vapor injection system may include a vapor injection device, a vapor injection fitting, and a vapor injection valve. The vapor injection fitting may be in communication with the vapor injection device and the vapor injection passage. The vapor injection valve may be disposed between the shell and the interior of the non-orbiting scroll.

Further areas of applicability will become apparent from the description provided herein. It should be understood that the description and specific examples are intended for purposes of illustration only and are not intended to limit the scope of the claims.

DRAWINGS

The drawings described herein are for illustration purposes only and are not intended to limit the scope of the present disclosure in any way.

DETAILED DESCRIPTION

The following description is merely exemplary in nature and is not intended to limit the present teachings, application, or uses.

Figure 1:
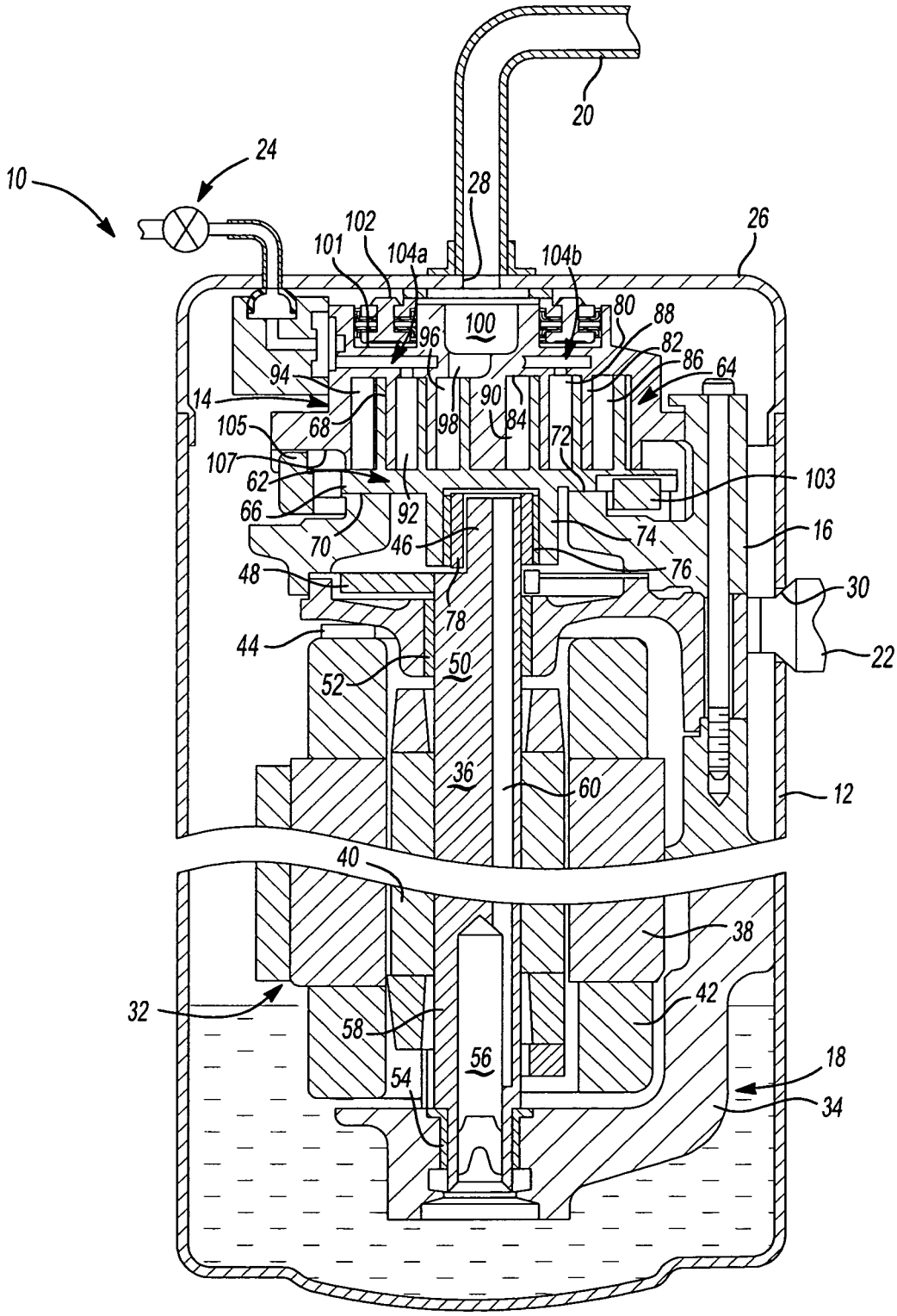
FIG. 1 is a sectional view of a compressor according to the present disclosure.

The present teachings are suitable for incorporation in many different types of scroll and rotary compressors, including hermetic machines, open drive machines and non-hermetic machines. For exemplary purposes, a hermetic scroll refrigerant motor-compressor 10 of the low-side type, i.e., where the motor and compressor are cooled by suction gas in the hermetic shell, as illustrated in the vertical section shown in FIG. 1, is described herein.

With reference to FIGS. 1, 3, 5, and 6, compressor 10 may include a cylindrical hermetic shell 12, a compression mechanism 14, a main bearing housing 16, a motor assembly 18, a refrigerant discharge fitting 20, a suction gas inlet fitting 22, and a vapor injection system 24. The hermetic shell 12 may house the compression mechanism 14, main bearing housing 16, and motor assembly 18. Shell 12 may include an end cap 26 at the upper end thereof. The refrigerant discharge fitting 20 may be attached to shell 12 at opening 28 in end cap 26. The suction gas inlet fitting 22 may be attached to shell 12 at opening 30. The compression mechanism 14 may be driven by motor assembly 18 and supported by main bearing housing 16. The main bearing housing 16 may be affixed to shell 12 at a plurality of points in any desirable manner.

The motor assembly 18 may generally include a motor 32, a frame 34 and a crankshaft 36. The motor 32 may include a motor stator 38 and a rotor 40. The motor stator 38 may be press fit into a frame 34, which may in turn be press fit into shell 12. Crankshaft 36 may be rotatably driven stator 38. Windings 42 may pass through stator 38. Rotor 40 may be press fit on crankshaft 36. A motor protector 44 may be provided in close proximity to windings 42 so that motor protector 44 will de-energize the motor 32 if the windings 42 exceed their normal temperature range.

The crankshaft 36 may include an eccentric crank pin 46 and one or more counter-weights 48 at an upper end 50. Crankshaft 36 may be rotatably journaled in a first bearing 52 in main bearing housing 16 and in a second bearing 54 in frame 34. Crankshaft 36 may include an oil-pumping concentric bore 56 at a lower end 58. Concentric bore 56 may communicate with a radially outwardly inclined and relatively smaller diameter bore 60 extending to the upper end 50 of crankshaft 36. The lower portion of interior shell 12 may be filled with lubricating oil. Concentric bore 56 may provide pump action in conjunction with bore 60 to distribute lubricating fluid to various portions of compressor 10.

Compression mechanism 14 may generally include an orbiting scroll 62 and a non-orbiting scroll 64. Orbiting scroll 62 may include an end plate 66 having a spiral vane or wrap 68 on the upper surface thereof and an annular flat thrust surface 70 on the lower surface. Thrust surface 70 may interface with an annular flat thrust bearing surface 72 on an upper surface of main bearing housing 16. A cylindrical hub 74 may project downwardly from thrust surface 70 and may include a journal bearing 76 having a drive bushing 78 rotatively disposed therein. Drive bushing 78 may include an inner bore in which crank pin 46 is drivingly disposed. Crank pin 46 may have a flat on one surface (not shown) that drivingly engages a flat surface in a portion of the inner bore of drive bushing 78 to provide a radially compliant driving arrangement, such as shown in assignee's U.S. Pat. No. 4,877,382, the disclosure of which is herein incorporated by reference.

Non-orbiting scroll 64 may include an end plate 80 having a non-orbiting spiral wrap 82 on the lower surface 84 thereof. Non-orbiting spiral wrap 82 may form a meshing engagement with wrap 68 of orbiting scroll 62, thereby creating an inlet pocket 86, intermediate pockets 88, 90, 92, 94, and outlet pocket 96. Non-orbiting scroll 64 may have a centrally disposed discharge passageway 98 in communication with outlet pocket 96 and upwardly open recess 100 which may be in fluid communication with discharge fitting 20.

Non-orbiting scroll member 64 may include an annular recess 101 in the upper surface thereof having parallel coaxial side walls in which an annular floating seal 102 is sealingly disposed for relative axial movement. The bottom of recess 101 may be isolated from the presence of gas under suction and discharge pressure by floating seal 102 so that it can be placed in fluid communication with a source of intermediate fluid pressure by means of a passageway (not shown). The passageway may extend into an intermediate pocket 88, 90, 92, 94. Non-orbiting scroll member 64 may therefore be axially biased against orbiting scroll member 62 by the forces created by discharge pressure acting on the central portion of scroll member 64 and those created by intermediate fluid pressure acting on the bottom of recess 101.

Figure 2:
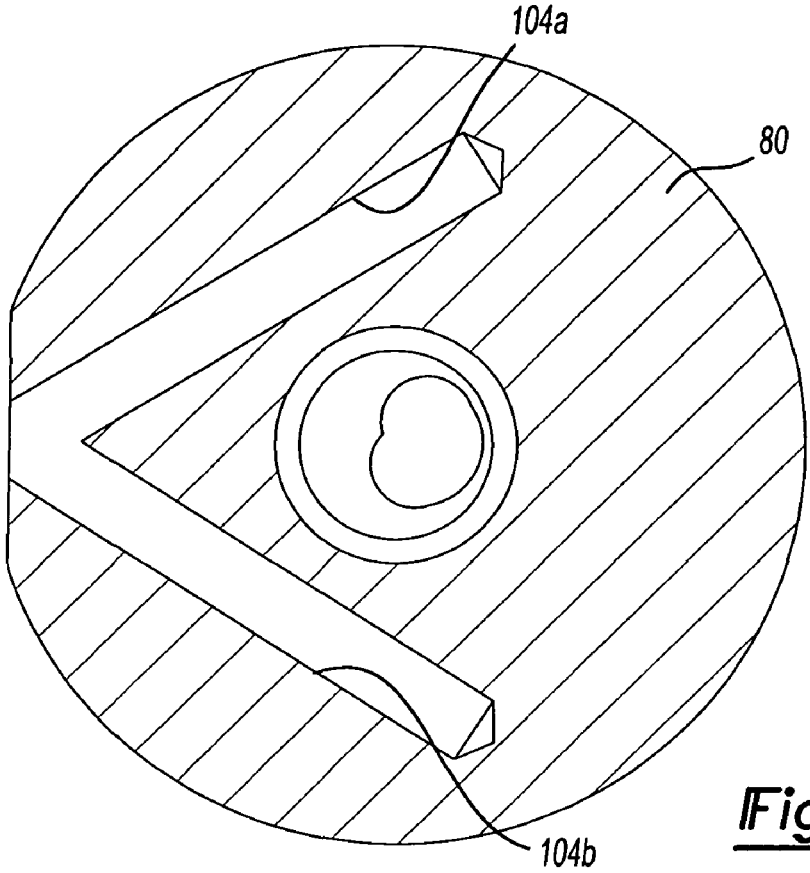
FIG. 2 is a sectional view of the non-orbiting scroll end plate of the compressor of FIG. 1.
Figure 3:
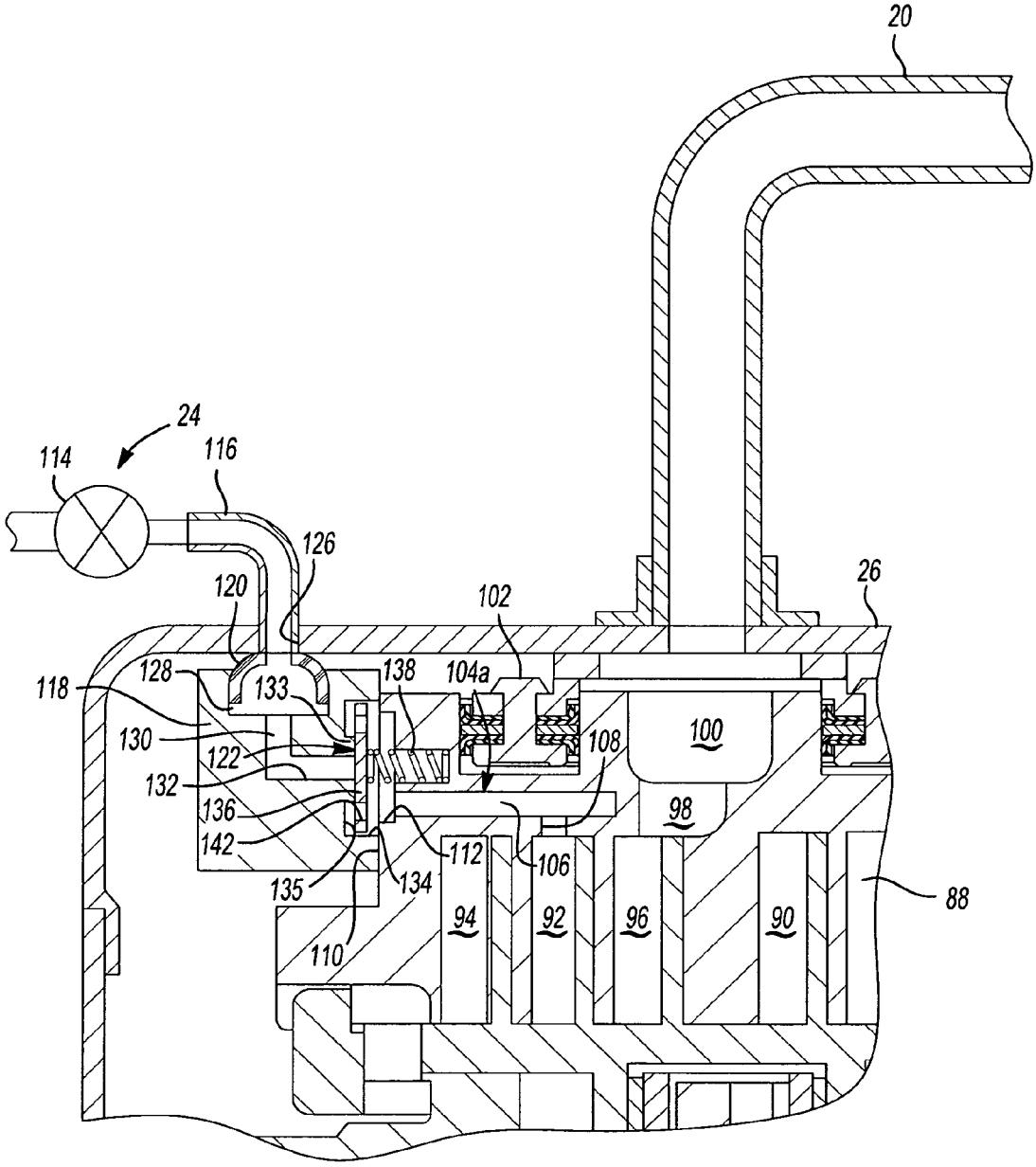
FIG. 3 is a fragmentary sectional view of the compressor of FIG. 1 including a valve arrangement.
Figure 5:
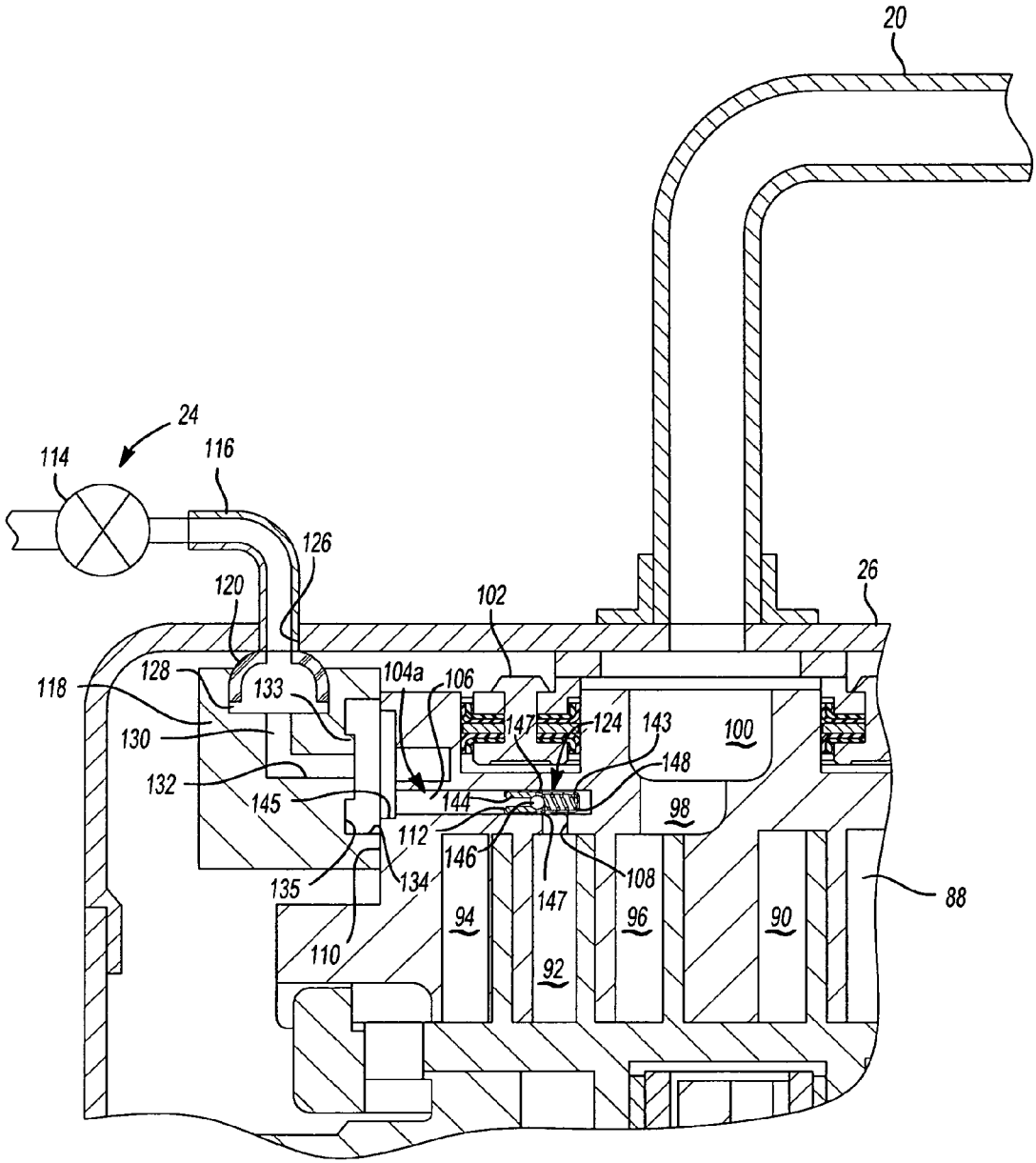
FIG. 5 is a fragmentary sectional view of the compressor of FIG. 1 including an alternate valve arrangement.
Figure 6:
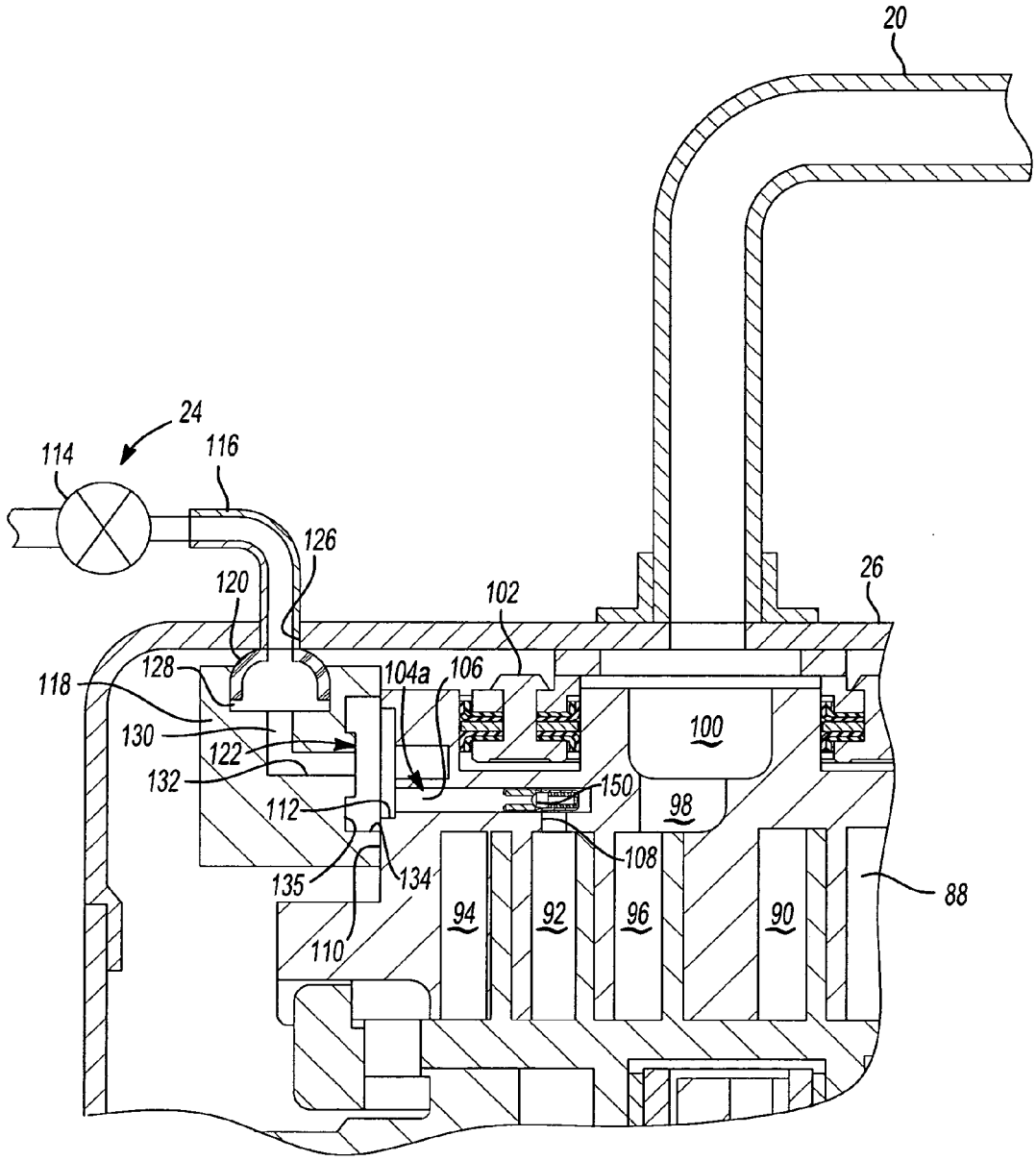
FIG. 6 is a fragmentary sectional view of the compressor of FIG. 1 including an alternate valve arrangement.

With additional reference to FIG. 2, vapor injection passages 104*a*, 104*b* may be located within non-orbiting scroll end plate 80 and may be in communication with vapor injection system 24. Vapor injection passage 104*a* and 104*b* may be generally similar. Therefore, only vapor injection passage 104*a* will be described with the understanding that the description applies equally to vapor injection passage 104*b*. As seen in FIGS. 3, 5, and 6, vapor injection passage 104*a* may include first and second portions 106, 108. First portion 106 may extend through sidewall 110 at opening 112 and generally radially into non-orbiting scroll 64. Opening 112 may form a recessed portion in sidewall 110 and may have a diameter greater than the diameter of first portion 106. Second portion 108 may intersect first portion 106 and extend through end plate lower surface 84, thereby providing communication between first portion 106 and intermediate pocket 92.

Non-orbiting scroll 64 may be mounted to main bearing housing 16 in any manner that will provide limited axial movement of non-orbiting scroll member 64. For a more detailed description of the non-orbiting scroll suspension system, see assignee's U.S. Pat. No. 5,055,010, the disclosure of which is hereby incorporated herein by reference.

Relative rotation of the scroll members 62, 64 may be prevented by an Oldham coupling, which may generally include a ring 103 having a first pair of keys 105 (one of which is shown) slidably disposed in diametrically opposed slots 107 (one of which is shown) in non-orbiting scroll 64 and a second pair of keys (not shown) slidably disposed in diametrically opposed slots in orbiting scroll 62.

The vapor injection system 24 may include a vapor injection device 114, a top cap fitting 116, a scroll fitting 118, and a top cap seal 120. Vapor injection device 114 may be located external to shell 12 and may be in communication with scroll fitting 118 through top cap fitting 116. Top cap fitting 116 may be in the form of a flexible line and may pass through and be fixed to opening 126 in shell 12.

Scroll fitting 118 may be in the form of a block fixed to sidewall 110 of non-orbiting scroll 64. Scroll fitting 118 may include an upper recessed portion 128 having top cap seal 120 disposed therein and engaged with end cap 26. Top cap seal 120 may provide sealed communication between top cap fitting 116 and scroll fitting 118, while allowing axial displacement of scroll fitting 118 relative to shell 12. Top cap seal 120 may be any of the seals noted above regarding seal 102.

Scroll fitting 118 may include first and second passages 130, 132 therethrough. First passage 130 may extend generally longitudinally from upper recessed portion 128. Second passage 132 may intersect first passage 130 and extend generally radially through scroll fitting 118. Scroll fitting 118 may include a side recessed portion 134 near second passage 132. Side recessed portion 134 may have a diameter greater than the diameter of second passage 132 and generally surround vapor injection passage opening 112. An annular wall 133 may extend into side recessed portion 134, forming an annular recess 135 therebetween. First and second passages 130, 132 may therefore be in communication with vapor injection passage 104*a*, generally forming a vapor injection passageway therewith.

Figure 4:
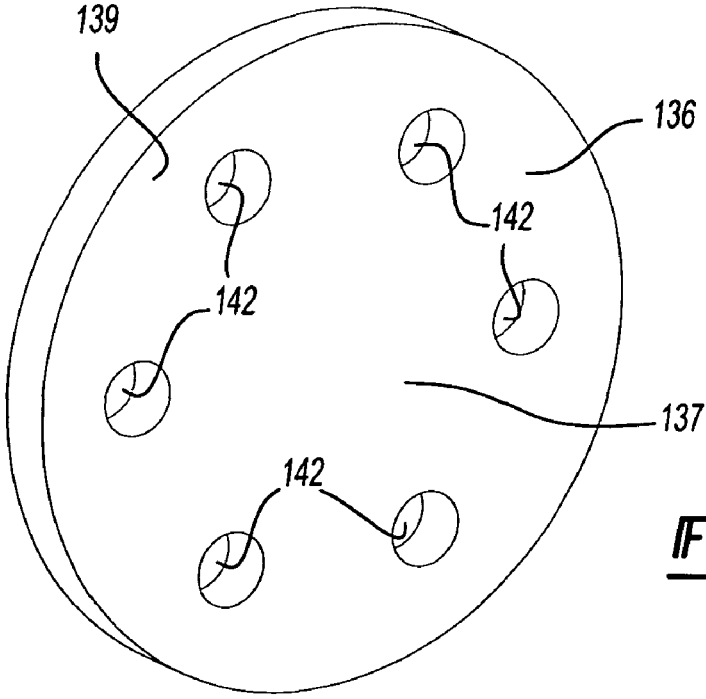
FIG. 4 is a perspective view of a valve member shown in the valve arrangement of FIG. 3.

With reference to FIG. 3, vapor injection system 24 may include a valve 122. Valve 122 may include a valve member 136 and a spring 138. With additional reference to FIG. 4, valve member 136 may be in the form of a disc having a diameter similar to the diameter of side recessed portion 134. Valve member 136 may include apertures 142 extending around a perimeter portion thereof. Valve member 136 may generally be divided into an inner diameter portion 137 and an outer diameter portion 139 by apertures 142. Spring 138 may be located between valve member 136 and non-orbiting scroll 64 to generally bias inner diameter portion 137 against annular wall 133 in a direction of flow from an interior portion to an exterior portion of non-orbiting scroll member 64, preventing flow from escaping past valve member 136, thereby reducing a dead volume between non-orbiting scroll 64 and vapor injection device 114.

With reference to FIG. 5, vapor injection system 24 may include a valve 124. Valve 124 may be located in non-orbiting scroll vapor injection passage 104*a*. More specifically, valve 124 may be located in vapor injection passage first portion 106. Valve 124 may include a housing 143 containing a valve seat 144, a ball 146, and a spring 148 therein. Housing 143 may have a first opening 145 allowing vapor from vapor injection device 114 to enter and a second set of openings 147 allowing the vapor to exit the housing and enter intermediate pocket 92. Seat 144 may be contained within housing 143 between first and second openings 145, 147. Valve 124 may be positioned near vapor injection passage second portion 108. Valve 124 may be arranged similar to valve 122, such that spring 148 may generally bias ball 146 against seat 144 in a direction of flow from an interior portion to an exterior portion of non-orbiting scroll member 64, thereby preventing flow from intermediate pocket 92 to vapor injection device 114 and reducing a dead volume between non-orbiting scroll 64 and vapor injection device 114.

Alternately, as seen in FIG. 6, ball 146 may be replaced with a piston 150. While valve 124 has been described in passage 104*a*, it is understood that an additional valve 124 may be disposed in passage 104*b* as well.

Operation of valve 122 will now be discussed with the understanding that the description applies equally to valve 124. As indicated above, valve member 136 is urged to a closed position by the combination of spring 138 and flow from intermediate pocket 92. The flow from intermediate pocket 92 and spring 138 produce a force on a back side of valve member 136, and therefore bias valve member 136 in a direction of flow from an interior portion to an exterior portion of non-orbiting scroll member 64.

During compressor operation, the pressure of the fluid within intermediate pocket 92 varies with rotation of crankshaft 36. More specifically, during each rotation of crankshaft 36, the fluid pressurized within intermediate pocket 92 may vary over a range of pressures. For exemplary purposes, fluid pressure in intermediate pocket 92 may vary between a first pressure and a second pressure and vapor injection device 114 may provide a fluid at an intermediate pressure between the first and second pressures. When the fluid provided by vapor injection device 114 provides a force on a front side of valve member 136, valve 122 will move between opened and closed positions based on the difference between the force provided by the intermediate fluid pressure from vapor injection device 114 on the front side of valve member 136 and the combination of the biasing force of spring 138 and the variable force provided by fluid from intermediate pocket 92 on the back side of valve member 136. The difference in force provided by the first and second fluid pressures from intermediate pocket 92 during each rotation of crankshaft 36 allows valve 122 to open and close once per revolution of crankshaft 36.

What is claimed is:

1. A compressor comprising:

a shell;

a compression mechanism contained within said shell and including a non-orbiting scroll axially displaceably mounted to said shell, said non-orbiting scroll having an exterior portion and an interior portion;

a vapor injection passage in communication with said interior portion and configured for communication with a source of vapor;

a motor contained within said shell and drivingly coupled to said compression mechanism; and a vapor injection valve disposed within said shell and in a radially extending portion of said vapor injection passage and operable to interrupt communication between said interior portion of said non-orbiting scroll and the source of vapor.

2. The compressor of claim 1, further comprising a vapor injection fitting having the vapor injection passage extending therethrough, said vapor injection fitting including a top cap fitting and a scroll fitting, said top cap fitting being in communication with an opening in said shell and said scroll fitting.

3. The compressor of claim 2, wherein said scroll fitting is fixedly coupled to said exterior portion of said non-orbiting scroll at said vapor injection passage.

4. The compressor of claim 2, wherein said scroll fitting includes an opening therethrough having a seal disposed therearound, said seal generally surrounding said opening in said shell, at least a portion of said seal being axially displaceable relative to said scroll fitting.

5. The compressor of claim 2, wherein said vapor injection valve is located within said scroll fitting.

6. The compressor of claim 2, wherein said scroll fitting includes a first passage extending generally axially relative to said non-orbiting scroll and a second passage forming a portion of said vapor injection passage and intersecting said first passage and extending generally radially relative to said non-orbiting scroll.

7. The compressor of claim 6, wherein said vapor injection valve is located within said second passage of said scroll fitting.

8. The compressor of claim 1, wherein said vapor injection valve is located within said vapor injection passage in said non-orbiting scroll.

9. The compressor of claim 1, wherein said vapor injection valve is normally biased to prevent flow from said interior portion of said non-orbiting scroll to said exterior portion of said non-orbiting scroll.

10. The compressor of claim 1, wherein said non-orbiting scroll includes an end plate having a lower surface with wraps extending generally perpendicular therefrom, said vapor injection passage having a first portion extending through said end plate at an angle of less than 90 degrees relative to said lower surface.

11. The compressor of claim 10, wherein said vapor injection valve is located within said first portion of said vapor injection passage.

12. The compressor of claim 10, wherein said vapor injection passage includes a second portion intersecting said first portion and extending through said lower surface of said end plate.

13. The compressor of claim 12, wherein said vapor injection valve is located proximate said second portion of said vapor injection passage.

14. The compressor of claim 1, wherein said vapor injection valve includes a valve member and a spring biasingly engaged with said valve member.

15. The compressor of claim 1, further comprising a seal located between said shell and said vapor injection passage, at least a portion of said seal axially displaceable relative to said non-orbiting scroll.

16. The compressor of claim 1, further comprising a drive shaft coupled to said motor and drivingly engaged with said compression mechanism, said vapor injection valve moving between a position allowing communication between said interior portion of said non-orbiting scroll and the source of vapor and another position blocking communication between said interior portion of said non-orbiting scroll and the source of vapor once per revolution of said drive shaft.

17. The compressor of claim 1, wherein said vapor injection valve includes a ball and a spring biasing said ball to a closed position.

18. The compressor of claim 1, wherein said vapor injection valve includes a piston and a spring biasing said piston to a closed position.

19. A compressor comprising:

a shell;

a compression mechanism contained within said shell and including a non-orbiting scroll axially displaceably coupled to said shell, said non-orbiting scroll having an exterior portion and an interior portion;

a motor contained within said shell and drivingly coupled to said compression mechanism;

a vapor injection passageway in communication with said interior portion of said non-orbiting scroll and configured for communication with a source of vapor;

a seal located within said shell and between said shell and said vapor injection passage, at least a portion of said seal axially displaceable relative to said non-orbiting scroll; and a vapor injection valve disposed in a radially extending portion of said vapor injection passageway and within said shell.

20. The compressor of claim 19, further comprising a vapor injection fitting including a top cap fitting and a scroll fitting, said top cap fitting in communication with an opening in said shell and said scroll fitting, said scroll fitting extending from said non-orbiting scroll, and said vapor injection fitting forming a portion of said vapor injection passageway.

21. The compressor of claim 19, further comprising a scroll fitting generally extending from said non-orbiting scroll and having a passage therethrough forming a portion of said vapor injection passageway, said seal disposed around an opening to said passage in said scroll fitting and generally surrounding an opening in said shell.

22. The compressor of claim 21, wherein said vapor injection valve is located within said scroll fitting passage.

23. The compressor of claim 19, wherein said vapor injection valve includes a valve member and a spring biasingly engaged with said valve member.

24. The compressor of claim 19, wherein said vapor injection valve is located within said vapor injection passageway and said non-orbiting scroll.

25. The compressor of claim 19, wherein said vapor injection valve is normally biased to prevent flow from said interior portion of said non-orbiting scroll to said exterior portion of said non-orbiting scroll.

26. The compressor of claim 19, further comprising a drive shaft coupled to said motor and drivingly engaged with said compression mechanism, said vapor injection valve moving between a position allowing communication between said interior portion of said non-orbiting scroll and the source of vapor and another position blocking communication between said interior portion of said non-orbiting scroll and the source of vapor once per revolution of said drive shaft.

27. The compressor of claim 19, wherein said vapor injection valve includes a ball and a spring biasing said ball to a closed position.

28. The compressor of claim 19, wherein said vapor injection valve includes a piston and a spring biasing said piston to a closed position.

* * * * *